United States Patent [19]

Holyk

[11] Patent Number: 4,661,385

[45] Date of Patent: Apr. 28, 1987

[54] FILTRATION STABILIZATION OF AUTODEPOSITION BATHS

[75] Inventor: Nestor M. Holyk, North Wales, Pa.

[73] Assignee: Amchem Products, Inc., Ambler, Pa.

[21] Appl. No.: 741,327

[22] Filed: Jun. 4, 1985

[51] Int. Cl.[4] ..... C23C 22/86; C23C 22/06

[52] U.S. Cl. ..... 427/345; 427/435; 523/343

[58] Field of Search ..... 523/343; 524/901; 427/345, 435

[56] References Cited

U.S. PATENT DOCUMENTS

| | | | |
|---|---|---|---|
| 3,663,402 | 5/1972 | Christenson | 204/181 |
| 3,709,743 | 1/1973 | Dalton | 148/6.2 |
| 3,839,097 | 10/1974 | Hall | 427/345 |
| 3,936,546 | 2/1976 | Hall | 427/345 |
| 4,177,180 | 12/1979 | Hall | 524/901 |
| 4,191,676 | 3/1980 | Hall | 524/901 |
| 4,229,492 | 10/1980 | Leister | 427/345 |
| 4,231,850 | 11/1980 | Kato | 204/181.7 |
| 4,310,450 | 1/1982 | Wang | 324/901 |
| 4,357,372 | 11/1982 | Leister | 427/345 |
| 4,414,350 | 11/1983 | Hall | 524/320 |

FOREIGN PATENT DOCUMENTS

| | | |
|---|---|---|
| 1266098 | 4/1968 | Fed. Rep. of Germany . |
| 51-41681 | 4/1976 | Japan . |

*Primary Examiner*—C. Warren Ivy

*Attorney, Agent, or Firm*—Ernest G. Szoke; Henry E. Millson, Jr.; Mark A. Greenfield

[57] ABSTRACT

A method for stabilizing the iron salt content of a PVDC latex autodeposition bath by: filtering a metered portion of the bath to separate it into a filtrate containing the iron salts and a retentate containing the latex and pigment particles; discarding the filtrate; recycling the retentate back into the bath; and adding D.I. water in a volume equal to that of the filtrate.

16 Claims, 1 Drawing Figure

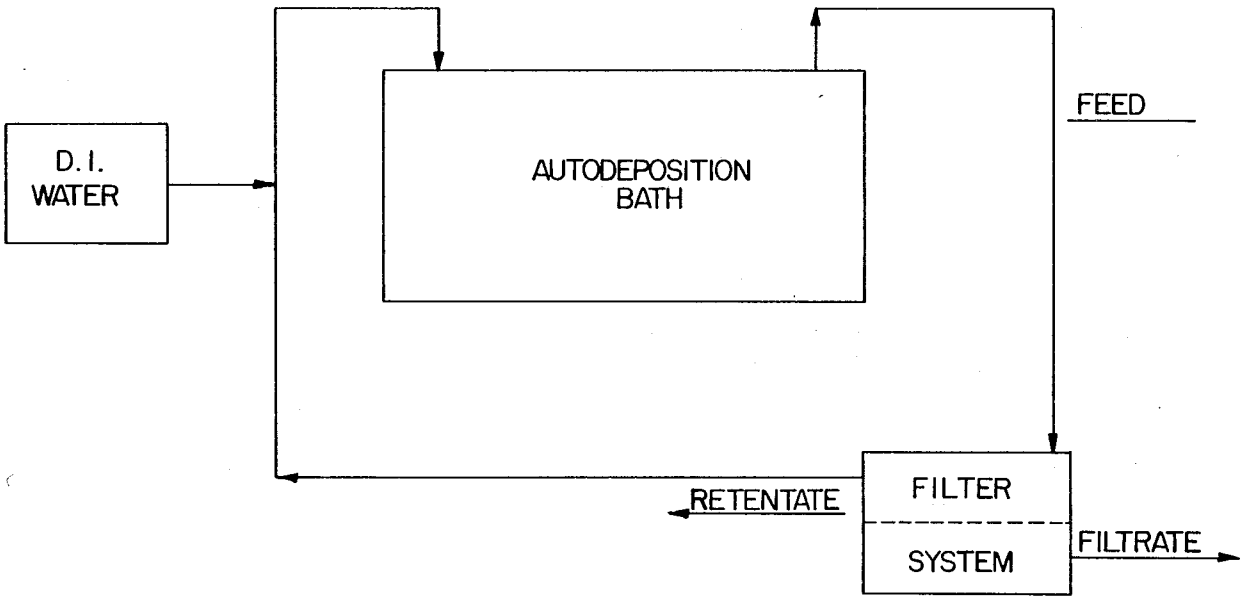
D.I.
WATER
AUTODEPOSITION
BATH
FEED
FILTER
SYSTEM
FILTRATE
RETENTATE

FILTRATION STABILIZATION OF AUTODEPOSITION BATHS

BACKGROUND OF THE INVENTION

1. Field of the Invention

This invention relates to stabilization of the amount of soluble iron salts in an autodeposition bath using continuous flow filtration.

2. Statement of the Related Art

In the autodeposition coating of iron-containing (e.g. steel) surfaces using an aqueous bath comprising a latex, optionally a pigment, and an activator system itself comprising at least hydrofluoric acid and a water-soluble ferric salt, the amount of iron salts in the bath is quite critical. Too small an amount produces no autodeposition. Too large an amount interferes with the coating process, unfavorably altering the coating characteristics of the bath.

Paradoxically, although a certain amount of ferric salts are necessary for the activation of the bath, the autodeposition process itself removes iron from the continually treated workpieces at a rate of about 20–100 mg Fe/ft$^2$ (about 200–1,000 mg Fe/m$^2$) of surface treated. In a large-scale continuous commercial application, such losses can translate into an iron build-up in the autodeposition bath to concentrations in excess of 3 g/l. At such concentrations, the bath interferes with the coating process, and the entire bath, including expensive resin components present, has been discarded in favor of a fresh bath.

Autodeposition baths may also contain small amounts of "tramp" (contaminating) salts such as sodium and potassium phosphates and sulfates, which are "dragged-in" from earlier steps of the continuous process.

Thus, there is a recognized need for a means of controlling and stabilizing the amount of iron (ferric) salts in the autodeposition bath at a predetermined amount.

In recent years, some iron ion control was achieved by adding phosphoric acid to autodeposition baths. This resulted in a precipitation of ferric phosphate which subsequently led to massive coprecipitation of latex particles. Non-ferric contaminant salts were unaffected. The end result was a sludge-laden bath that resulted in erratic performance and control characteristics.

U.S. Pat. No. 4,414,350 discloses complexing the iron salts, present in excess concentration in an autodeposition bath, with at least one carboxylic acid such as acetic, succinic, acrylic, and the like. This also resulted in a sludge-laden bath.

More recently, as disclosed in copending U.S. patent application Ser. No. 06/725,470, which is commonly assigned herewith and whose disclosures relating to iron salt build-up are incorporated herein by reference, a method of bath stabilization (i.e. iron ion control) has been proposed in which one continuously or intermittently discards a predetermined volume of the bath, which volume is replaced by an equal volume of water, the discard rate being chosen so as to maintain a substantially constant concentration of iron salts in the bath. Independently of this, the other ingredients of the bath (latex, pigment, acid, etc.) are replenished at a rate sufficient to maintain each at its original concentration. The results of this method have been excellent with regard to bath performance and stability. However, a considerable amount of latex and pigment is irretrievably lost, which increases the cost of the autodeposition process.

SUMMARY OF THE INVENTION

A method is afforded for removal of excess iron salts from an aqueous autodeposition bath, and/or stabilization of the iron salt content of such bath, by filtration, preferably ultrafiltration or microfiltration in which the filtrate containing predominantly dissolved excess iron salts is discarded, and the retentate containing predominantly latex and pigment particles is recycled back to the bath, together with an added volume of deionized water equal to the volume of filtrate. Bath composition (other than iron salt) is maintained independently by replenishment in a known manner.

The preferred autodeposition bath for use in conjunction with this invention contains an internally stabilized polyvinylidene chloride (PVDC) latex, and an activator comprising hydrofluoric acid and a ferric salt, preferably ferric fluoride. Details of such an autodeposition bath are disclosed in U.S. patent application Ser. No. 06/723,677, which has been commonly assigned, and which is entirely incorporated herein by reference.

Autodeposition baths containing externally stabilized PVDC latexes (i.e. with a surfactant adsorbed on the latex particles and/or as disclosed in U.S. patent application Ser. No. 06/723,677) are also believed to be useful in conjunction with this invention. However, as will be demonstrated by the comparative examples which follow, the commonly used SBR latices and acrylic latices are not useable in conjunction with this invention. Therefore, the method of this invention is limited to the treatment of autodeposition baths containing at least predominantly PVDC latices. The physical configuration of the filtration apparatus is not critical, except that it must create turbulent flow at the membrane surface, to prevent failure caused by sludge and/or latex accumulation. For this reason, a "dead-end" filter configuration is inoperable for the purposes of this invention as is a filter affording simple laminar flow across the filter membrane. Similarly the membrane form is not critical, and it may be flat, baffled, or tubular in straight, curved, or helical configuration.

The critical physical characteristics of the filtration cell or cells are that it must freely pass the dissolved iron and contaminant salts, which should predominate in the filtrate, while retaining the valuable latex and pigment particles which should predominate in the retentate.

As a theoretical ideal, which can never be attained, the filter should remove 100% of the soluble salts from the feed and recycle 100% of the latex and pigment particles back to the bath. It should be apparent that if this theoretical ideal were achievable, the filtration system would only be used sporadically for incremental reduction and maintenance of the iron salt content of the entire autodeposition bath. Since this ideal cannot even be approached, for both technological and economic reasons, attention was focused on a relatively simple and economical filtration system and method which was capable of maintaining the iron salt content of the bath within given parameters for an indefinite period of time, with minimal down-time for cleaning the apparatus, removing accumulated sludge from the membrane, or replacing the membrane. The pressure, flow rate, and bath temperature obviously may all affect the filtration rate. However, no one of these is critical to this invention, except that too high a pressure might cause premature fouling, depending upon the filtration cell and membrane configuration.

The membrane material does not appear to be critical, cellulose acetate, polysulfone, polypropylene, acrylic, and tetrafluoroethylene or similar polymers all being satisfactory. A longer lived material is generally preferable.

Because the latex particles may be about 0.1μ and the pigment particles about 0.03μ in diameter, the membrane pore size is critical. However, the particle configuration and other factors must be considered, since some membrane pore sizes larger than the particle size may still be acceptable.

It is known that when solid particles are subjected to filtration, the particles tend to accumulate on the membrane itself, perhaps partially because of the negative pressure on the filtrate side. It is because of this phenomenon that dead-end and laminar flow filtration is not effective for the purposes of this invention. However, even where a substantial accumulation of such particles is avoided, a thin layer or coagulum of particles may be formed on the upstream side of the filter, which layer itself acts as a filter. It is believed that the formation of such a layer is what permits one to use a membrane with a pore size substantially larger than the particle size of the retentate solids, for the purposes of this invention.

An additional and important factor, is that a highly efficient filter is not necessary, and may even be less preferred. Since the filtration of the autodeposition bath contemplated by this invention is a continuous flow process rather than a batch process, a filter system capable of removing even 1–2% of the remaining iron and contaminant salts each pass, will easily maintain and/or stabilize the baths iron salt content at desired levels. When applied to an autodeposition bath with an initial excess of iron salts, the same filter system will bring the iron salt content down to a desired range after a period of continuous operation, the time of which must vary with the amount of excess salts, and the capacity of the filter system. When operating within a desired iron salt range, the filter system may run intermittently with a larger capacity filter system or continuously with a smaller capacity filter system. As used herein, the term "capacity" refers to the amount of filtrate passing through a given membrane surface area in a 24 hour day. In the American system, this is expressed in Gallons per square Foot per Day (GFD) and in the metric system in Liters per square Meter per Day (LMD). One GFD equals 40.8 LMD.

BRIEF DESCRIPTION OF THE DRAWING

The drawing is a schematic flow diagram of the inventive method.

DETAILED DESCRIPTION OF THE INVENTION

Other than in the operating examples, or where otherwise indicated, all numbers expressing quantities of ingredients, reaction conditions, or defining ingredient parameters used herein are to be understood as modified in all instances by the term "about".

Given the above comments, the useable membrane pore size range was found to be 0.0002μ–2.0μ. A smaller size will not permit the iron or other contaminant salts to pass, a larger size will permit all of the latex and pigment particles to pass. A preferred pore size range is 0.002μ–0.8μ, which has been shown to be effective, but which passes a relatively large amount of solid particles. A more preferred pore size range is 0.005–0.5μ, which yields somewhat better results. The ideal and most preferred pore size range is 0.01–0.3μ.

As may be apparent from the Drawing, the contents of the autodeposition bath (i.e. latex, pigment, acid preferably hydrofluoric, ferric salt activator, excess iron salt, and contaminant salts) are directed by a feed conduit into the filter system, where the contents are separated into a filtrate containing predominantly the soluble salts to be eliminated but also (less desireably) small quantities of latex and pigment, and some of the acid, as well as water from the latex dispersion, and a retentate containing all of the remaining bath ingredients. The filtrate is discarded, and the filtrate conduit may therefore lead to a holding or storage tank, or the like, before disposal. The retentate is directed by a retentate conduit back into the autodeposition bath. It is critical that the volume and solid/liquid ratio of the bath are maintained, and for this purpose a source of deionized (D.I.) water is required. The D.I. water is added to the autodepostion bath in a volume exactly equal to that of the removed filtrate. In the embodiment shown in the Drawing, a D.I. water conduit leads directly into the retentate conduit, so that their mixture is fed directly into the bath. In another embodiment, not shown, the D.I. water may be added separately, rather than mixing with the retentate. As is usual with systems containing hydrofluoric acid, the conduit and filter system should be made of a non-corrodible material, preferably plastic or stainless steel. Pumps of known design may be connected to the conduits as needed, supplying flow pressures of 5 to 30 psi, as desired. Known metering and monitoring means may be provided for assuring that the volume of added D.I. water is equal to the volume of filtrate. Known metering and monitoring means may also be provided to activate and then deactivate the filtration system when the iron salt content becomes excessive, or this may be accomplished manually after testing of the bath.

The required capacity of the filtering system (in GFD or LMD) is very hard to define, because it depends upon the size of the bath tank, the desired amount of ferric ions in the bath activator, and the composition of the iron-containing substrate being coated by the autodeposition process. An additional complication is whether the iron salt content of the bath is to be reduced or only maintained. This latter is unimportant, of course, once the filter system has brought the iron salt content under control.

Given the above caveats, one can state the capacity range of the filter should be sufficient to maintain the iron salt content within ±5% of a desired range, preferably ±2.5%, most preferably ±1%. The desired range of iron salts operating as part of the activator system in the autodeposition baths useful in conjunction with this invention is 0.5–3 g/l, preferably 1–2 g/l.

The usual replenishing of the bath (i.e. replacement of exhausted latex, pigment, and acid) is conducted independently of the filtration, and does not form a part of this invention, nor is it shown in the Drawing.

The filtration systems or cells useful in this invention are commercially available, or may readily be fabricated to order. They include, but are not limited to, the following.

The Memtek Corporation (Woburn, Mass. 01801, U.S.A.) filtration system is a low pressure ultrafiltration system designed to separate and concentrate solids from liquids in industrial processing. It comprises straight tubular membranes housed in a PVC module, having a capacity of 200–400 GFD when operating at pressures of 20–40 psi.

Amicon Corporation (Lexington, Mass. 02173, U.S.A.) among others, manufactures hollow fiber systems with ultrafiltration surfaces membranes, with known utility for diafiltration.

Dorr-Oliver Corp. (Stamford, Conn. 06904, U.S.A.), among others, manufactures plate and frame type membrane cartridges which employ parallel leaf ultrafiltration membranes.

Mitsubishi Rayon Co. Ltd. (Tokyo, Japan) manufactures a polyethylene hollow fiber ultrafiltration membrane and filter system.

Gelman Sciences, Inc. (Ann Arbor, Mich. 48106, U.S.A.) manufactures a crossflow filtration system under the trademark "ACROFLUX", that is one of the preferred filters for use in this invention. It employs a linear cartridge in which the feed stream enters from the bottom and the permeate and retentate exit separately from the top. This plastic cartridge houses a complex folded membrane having pore sizes of 0.2μ, 0.8μ, or 1.2μ. Most importantly, a turbulence promoting screen is closely associated with the membrane, thus preventing undesireable simple laminar flow. The cartridge housings are available in talc-filled polypropylene, polytetrafluoroethylene, and stainless steel, all of which may be used in the method of this invention.

Osmonics, Inc. (Hopkins, Minn. 55343, U.S.A.) manufactures several filtration systems that are also preferred for use in this invention, which will be described in the following examples.

Abcor, Inc. (Wilmington, Mass. 01887, U.S.A.) is another manufacturer of filtration systems for industrial processes, including tubular ultrafiltration units, and the like, which are also preferred for use in this invention.

Various membranes can be substituted in manufacturers' cartridges to achieve the optimum filtration effect for the methods of this invention. Such membranes (and membrane cartridges) are available from: the Brunswick Technetics Division, under the trademark "BTS"; Pall Corp. under the trademark "HDC"; and from Nucleopore Corp. under the trademark "NUCLEOPORE"; as well as from the various manufacturers listed above.

EXAMPLES

The following examples and comparative examples are only representative of the extensive testing of filter materials and methods that was conducted in connection with this invention.

EXAMPLE 1

A Gelman "ACROFLUX" capsule having a 1 $ft^2$ acrylic membrane with a 0.2μ pore size was tested with an autodeposition bath employing an internally stabilized polyvinylidene chloride latex, as disclosed in U.S. patent application Ser. No. 06/723,677, above. The test was designed to ascertain whether the permeate flux (A) was high enough to be useful in industrial applications, and (B) remained relatively constant over time, thus assuring that the membrane was not quickly "blinded" (i.e., clogged) by the latex and/or pigment particles.

The filtration capsule was connected to the bath discharge side of a Wilden model M-1 diaphragm pump and the transmembrane pressure adjusted to about 8 psig. The autodeposition bath was about 5% w/w total solids and had a soluble iron salt (ferric fluoride) content of 1.79 g/l. The permeate was collected and titrated to determine iron concentration. The permeate iron concentration was found to be identical to that of the bath. This demonstrates that the membrane was not rejecting the iron salts, but rather allowing them to pass through. Initially the permeate was somewhat turbid due to the passage of latex and pigment particles through the membrane. After several hours of operation, the permeate became clear, which implies that a boundary layer (coagulum) formed at the membrane/-bath interface, which layer aided in the filtration.

The flux over a period of several days was quite consistent at 25 to 30 GFD. Based upon the above, it was concluded that this filtration system would perform satisfactorily in controlling the amount of soluble iron salts and other soluble salts in an autodeposition bath.

EXAMPLE 2

An Osmonics type S-20 KPS polysulfone filtration membrane having a 0.002μ pore size was tested with the same autodeposition bath as in Example 1. The filtration housing was a Bio Consep Membrane Flat Cell, and the membrane itself had an area of 10 $in^2$. Using a mean pressure of 6 psi the mean flux was 29.04 GFD. When the mean pressure was increased to 10 psi, the mean flux rose to 39.45 GFD. This test was sufficiently successful to warrant a scaled-up version.

EXAMPLE 3

A scaled-up version of Example 2 was conducted, only using an 11 $ft^2$ spiral wound cartridge. Two cartridges were tested.

The first cartridge used an Osmonics type S-20 KPS membrane, and was run at pressures of 7, 8.5, 11, and 15 psi. The mean fluxes at these pressures were, respectively, 2.55, 4.52, 6.51 and 10.85 GFD. Subsequently, blinding of the membrane began to occur, resulting in gradual loss of flux. The filtration was halted when the mean flux dropped to 6.16 GFD at 15 psi. It is believed that this blinding was caused by bath left in the cartridge when the flow was stopped, perhaps a settling of the coagulum layer at the bath/membrane interface.

The second cartridge used a type S-50 KPS membrane which had a pore size of 0.005μ. The filtration was run at a constant pressure of 15 psi. When the pump was stopped, the cartridge was rinsed with, and then stored in, D.I. water and hydrofluoric acid, until the pump was restarted. The filter cartridge was successfully run for 26 hours before being shut down. The high GFD was 19.46, the low GFD was 16.24, and the mean GFD was 17.71.

COMPARATIVE EXAMPLE A

An autodeposition bath based on an SBR latex and with a hydrofluoric acid/ferric fluoride activator was prepared. The bath had an iron (salt) content of 0.5 g/l. The bath was run through ABCOR model HFM100 and model HFM180 filtration systems, which employ linear polysulfone ultrafiltration tubes having a pore size estimated at 0.002μ. The filtration was aborted after only 1 minute of operation, because the flux was reduced to 0, indicating complete blockage of the membrane.

COMPARATIVE EXAMPLE B

An autodeposition bath based on an acrylic latex and with a hydrofluoric acid/ferric fluoride activator was prepared. The bath had an iron (salt) content of 2 g/l. The bath was run through an identical Gelman capsule to that used in Example 1. Filtration was aborted after about 15 minutes because of extremely low flux, indicating almost complete blockage of the membrane.

COMPARATIVE EXAMPLE C

Comparative Example B was repeated using a different acrylic latex. Filtration was aborted after 2 hours because of extremely low flux, indicating almost complete blockage of the membrane.

ANALYSIS OF EXAMPLES AND COMPARATIVE EXAMPLES

Comparing the successful results of Examples 1–3 with the unsuccessful results of Comparative Examples A–C, and in particular comparing Example 1 with Comparative Examples Band C, it is quite apparent that the choice of latex is critical to the successful performance of the method of this invention. Perhaps it would be more accurate to state that the method of this invention is intended to operate exclusively in conjunction with excess iron salts in a PVDC latex autodeposition bath, and is ineffective in acrylic latex or SBR latex autodeposition baths. This was a surprising and unexpected result, since there was no known information that would so indicate. As a partial theoretical explanation, not intended to be limiting, it may be noted that latex particles having a surfactant adsorbed on them tend to be extremely shear sensitive. As a result, if such particles are sheared or rubbed together too quickly, the adsorbed surfactant may be removed, permitting the particles to coagulate. If this occurs at a membrane surface, such particles would tend to form a substantially impermeable coagulum.

I claim:

1. In a method for forming an autodeposited coating on a metallic surface and for stabilizing the iron salt content of an autodeposition bath which is used to form said coating, said bath comprising latex particles, at least a predominant portion thereof being poly(vinylidene chloride) particles, optionally pigment particles, and an activator containing at least an acid and a ferric salt, said ferric salt being present in a range of 0.5–3 g/l of ferric ions; and wherein, during the course of the coating process, there is a tendency for iron to build up in concentration in the bath and to interfere with the coating process, the improvement comprising controlling the amount of iron in the bath to maintain the effectiveness of the coating process by:

maintaining the amount of ferric salt in said bath within said range by removing a portion of said bath and feeding said portion to non-dead end filtration means under non-laminar flow conditions, said filtration means having a pore size of 0.0002 to 2.0$\mu$, whereby the portion is separated into an aqueous filtrate comprising predominantly dissolved iron salts and any dissolved contaminant salts present and an aqueous retentate comprising predominantly latex particles and optionally pigment particles;

discarding said filtrate;

recycling said retentate back into said autodeposition bath;

adding to said bath a volume of D.I. water equal to the volume of filtrate; and continuing the stabilization process until the amount of ferric salt is within ±5% of the initial starting range.

2. The method of claim 1 wherein said retentate and said D.I. water are combined and said combination is charged to said bath.

3. The method of claim 1 wherein the removal of the bath portion, the addition of said D.I. water, and the recycling of said retentate are continuously metered and monitored, so that the volume and solids content of said bath remains constant.

4. The method of claim 3 wherein said metering and monitoring are conducted manually.

5. The method of claim 3 wherein said metering and monitoring are conducted by automatic means.

6. The method of claim 1 wherein the ferric ion content of said autodeposition bath is 1–2 g/l.

7. The method of claim 1 wherein said stabilization process is continued until the amount of ferric salt is within ±2.5% of the initial starting range.

8. The method of claim 6 wherein said stabilization process is continued until the amount of ferric salt is within ±2.5% of the initial starting range.

9. The method of claim 1 wherein said stabilization process is continued until the amount of ferric salt is within ±1% of the initial starting range.

10. The method of claim 6 wherein said stabilization process is continued until the amount of ferric salt is within ±1% of the initial starting range.

11. The method of claim 1 wherein substantially all of said latex particles are poly(vinylidine chloride) particles.

12. The method of claim 1 wherein said filtration means comprises a filter housing and a filter membrane, said membrane having a pore size range of about 0.002 to 0.8 micron.

13. The method of claim 1 wherein said filtration means comprises a filter housing and a filter membrane, said membrane having a pore size range of 0.005 to 0.5 micron.

14. The method of claim 1 wherein said filtration means comprises a filter housing and a filter membrane, said membrane having a pore size range of about 0.01–0.3 micron.

15. The method of claim 1, 11, 12, 13 or 14 wherein said latex particles are internally stabilized.

16. The method according to claim 15 wherein said activator consists essentially of hydrofluoric acid and ferric fluoride.

* * * * *